United States Patent [19]

Wyatt

[11] Patent Number: 4,558,197

[45] Date of Patent: Dec. 10, 1985

[54] POTATO COOKER FOR MICROWAVE OVENS

[75] Inventor: Tim A. Wyatt, Portland, Oreg.

[73] Assignee: Leem Company, Inc., Portland, Oreg.

[21] Appl. No.: 584,794

[22] Filed: Feb. 29, 1984

[51] Int. Cl.[4] ..... H05B 6/80

[52] U.S. Cl. ..... 219/10.55 E; 219/10.55 R; 99/419; 99/DIG. 14

[58] Field of Search ..... 219/10.55 E, 10.55 R, 219/10.55 F; 99/419, DIG. 14; 426/243, 241; D7/409

[56] References Cited

U.S. PATENT DOCUMENTS

| | | | |
|---|---|---|---|
| 931,587 | 8/1909 | Fairbanks | 99/419 |
| 997,653 | 7/1911 | Doersch | 99/419 |
| 1,339,350 | 5/1920 | Kelley . | |
| 1,630,188 | 5/1927 | Knauff | 99/419 |
| 1,969,601 | 8/1934 | Foch | 99/419 |
| 2,096,726 | 10/1937 | Barton | 99/419 |
| 2,495,435 | 1/1950 | Welch | 219/10.55 E X |
| 3,302,632 | 2/1967 | Fichtner | 219/10.55 E X |
| 3,379,118 | 4/1968 | Perez | 99/419 |
| 4,074,102 | 2/1978 | Asen | 219/10.55 E |
| 4,112,833 | 9/1978 | Oda et al. | 219/10.55 E X |
| 4,121,510 | 10/1978 | Frederick | 219/10.55 E X |
| 4,249,464 | 2/1981 | Hansen | 219/10.55 E X |
| 4,286,133 | 8/1981 | Einset et al. | 219/10.55 E |
| 4,343,978 | 8/1982 | Kubiatowicz | 219/10.55 E |

*Primary Examiner*—Philip H. Leung
*Attorney, Agent, or Firm*—Klarquist, Sparkman, Campbell, Leigh & Whinston

[57] ABSTRACT

A baking device especially for baking potatoes in a microwave oven comprises a molded microwave transparent plastic ring having integral generally wedge-shaped but thin upstanding blades spaced about its circumference. A flange on the ring provides a handle for lifting the device. The broad opposing surfaces of each blade merge at relatively thin, sharp edges for penetrating a potato but the apex of each blade is rounded for safety. A moisture ventilation slot extends through the blade vertically between its apex and the base. The slot terminates below a stop flange to ensure the escape of moisture from a potato as it cooks. The blades are inclined inwardly from the vertical to prevent tipping the ring when a potato is pushed onto a blade.

17 Claims, 4 Drawing Figures

FIG. 1
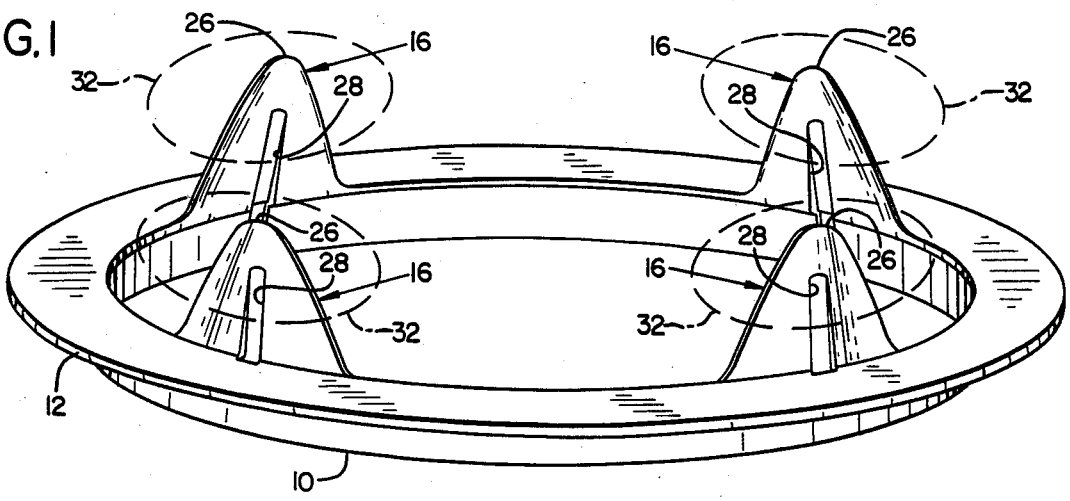
FIG. 2
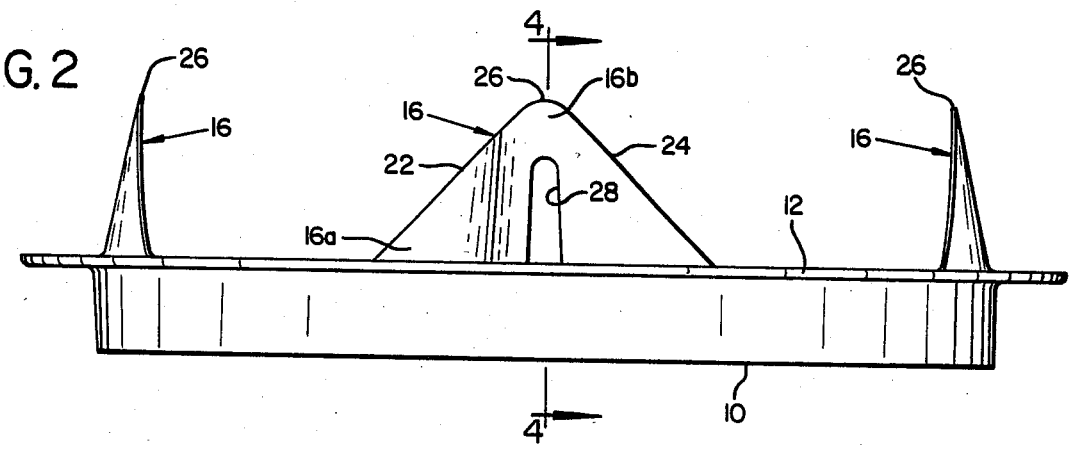
FIG. 4
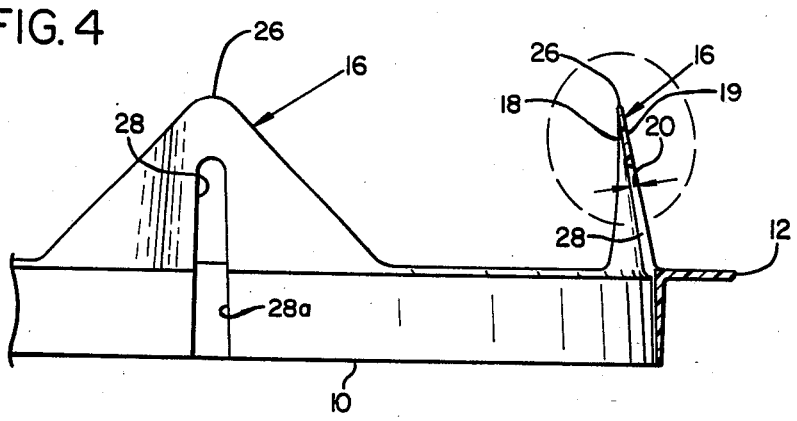
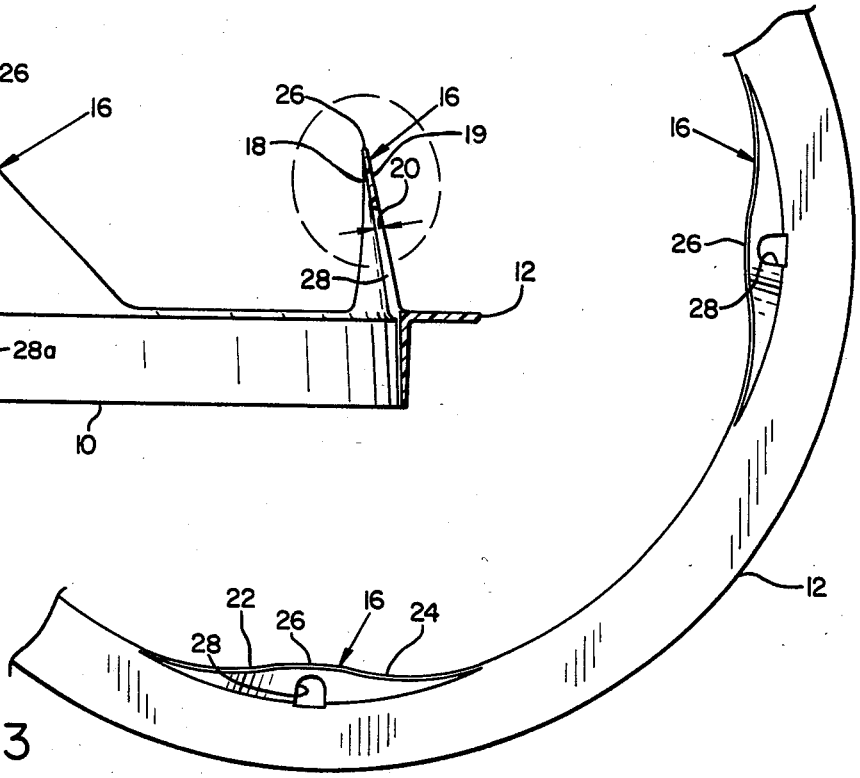
FIG. 3

POTATO COOKER FOR MICROWAVE OVENS

BACKGROUND OF THE INVENTION

The present invention relates to cookware for use in microwave ovens and more particularly to a baking device especially for baking potatoes in a microwave oven.

Various devices have been suggested for increasing the efficiency of baking a potato in an oven. For example, metal racks equipped with upright spikes for impaling potatoes have been suggested for this purpose, with the spikes serving to hold the potatoes in spaced apart relationship on the rack to expose all surfaces of all potatoes to the cooking heat and at the same time conduct heat through the spikes to the interior of the potatoes. Such racks are typified by those shown in Perez U.S. Pat. No. 3,379,118, Foch U.S. Pat. No. 1,969,601, and Kelley U.S. Pat. No. 1,339,350. However, such racks are not suitable for use in microwave ovens because they are usually made of metal or other materials that are not microwave compatible. In addition, the spikes of such racks do not adequately ventilate moisture and gases from the interior of the potatoes while cooking and therefore do not prevent the possibility of exploding a potato, which hazard is much greater in microwave cooking than in conventional cooking. Finally, such sharp pointed spikes present a safety hazard to the user.

Others have suggested a modification of the aforementioned spike-type racks for cooking potatoes. For example, in Knauff U.S. Pat. No. 1,630,188, Doersch U.S. Pat. No. 997,653, and Fairbanks U.S. Pat. No. 931,587, metal racks are provided with upright pointed teeth or tongues of thin metal on which to impale the potatoes for cooking. However, such teeth have many of the same drawbacks as spikes for use in baking potatoes. The teeth, like spikes, do not adequately ventilate the potato and therefore do not prevent the potato from exploding; the teeth, like the racks which support them, are not made of a microwave transparent material and therefore are unsuitable for use in microwave ovens; and the sharp pointed teeth, like spikes, can cause accidental injury to the user of the rack.

Cookware designed especially for use in microwave ovens is available. However, typically such cookware takes the form of a rack, tray, or pan made of a microwave compatible material such as a suitable plastic or paperboard product. Such cookware is typified by the disclosures in Hanson U.S. Pat. No. 4,249,464, Frederick U.S. Pat. No. 4,121,510, Fichtner U.S. Pat. No. 3,302,632, and Welch U.S. Pat. No. 2,495,435. However, such cookware is unsuitable for the efficient baking of potatoes in a microwave oven mainly because they provide no means for holding and optimally spacing and positioning the potatoes in the microwave oven for the most efficient baking, and they provide no means for venting the potatoes while baking.

Accordingly, there is a distinct need for a device especially designed for baking potatoes in a microwave oven which overcomes the deficiencies of the aforementioned prior art. Primary objectives of the invention, therefore, are to provide a device especially for baking potatoes in a microwave oven that will:

1. Optimally space and position the potatoes in a microwave oven for efficient use of the microwave energy;

2. Easily mount potatoes on the device;
3. Mount potatoes without danger of injury to the user;
4. Vent moisture and gases from the potatoes while baking;
5. Prevent the device from tipping while potatoes are mounted thereon;
6. Nest with similar such devices for efficient storage;
7. Handle easily;
8. Resist the effects of microwave energy;
9. Clean easily; and
10. Manufacture easily and at low cost.

SUMMARY OF THE INVENTION

In a preferred embodiment, the invention comprises a self-supporting annular base having upstanding blades spaced about the circumference of the base, with the base and blades being molded integrally of a microwave compatible plastic material. Each blade may comprise opposing wide blade surfaces merging at relatively sharp free edges, with the apex or tip of the blade being rounded or otherwise blunted for safety. Each blade may include a ventilation slot extending generally vertically from the annular base below the blade to an apex portion of the blade to provide a ventilation port for the potato while baking. The base or blades or both may be inclined inwardly from the vertical to prevent the base from tipping when a potato is impaled on a blade. The base may include laterally extending flange portions which serve as handles and limit the extent of nesting of multiple stacked such devices. The flange portions also serve as a stop to limit penetration of the blades into potatoes and thereby ensure that a vent slot always extends below the lowermost surface of a potato on a blade for adequate venting of the potato while cooking. This feature also prevents a potato from splitting in two and avoids the possibility of driving a blade into the hand while impaling a potato.

The foregoing objects, features, and advantages of the present invention will become more apparent from the following description which proceeds with reference to the accompanying drawing.

BRIEF DESCRIPTION OF DRAWING

FIG. 1 is a perspective view of a potato baking device in accordance with the invention;

FIG. 2 is an elevational view of the device in FIG. 1;

FIG. 3 is a partial top plan view of the device of FIGS. 1 and 2;

FIG. 4 is a vertical sectional view taken along the line 4—4 of FIG. 2.

DETAILED DESCRIPTION OF A PREFERRED EMBODIMENT

Referring to the drawing, the potato baker of the invention includes an annular ring-like base member 10 having a continuous upper rim flange 12 which provides handles for gripping the member. Integral with the base are a plurality of, in this case four, upstanding blades 16 spaced at regular intervals about the circumference of the base. The annular base and blades are made of a molded plastic microwave transparent material such as, for example, a polycarbonate sold under the brand name Lexan.

Each blade 16 is thin and generally triangular or wedge-shaped and includes opposing broad surfaces 18,19 extending in the direction of the annular base separated by a thin thickness dimension 20. As seen in FIG. 4, such thickness dimension increases progressively from top to bottom of the blade for strength and manufacturing considerations. However, as shown in FIG. 3, the broad surfaces 18,19 converge along free side edges 22,24 and an apex edge 26. Each blade includes a relatively wide base portion 16*a* and a relatively narrower apex portion 16*b* defined by opposite side edges 22,24. Such edges extend upwardly from the base portion and converge at a rounded or otherwise blunt apex 26. Although the apex is rounded in profile for safety, the free edge portions 22,24 and apex edge 26 formed by the converging of the broad blade surfaces 18,19 are relatively sharp for easily penetrating the skin and meat of a raw potato pushed onto the blade.

A generally vertical slot 28 extends through each blade from one broad surface to the other and generally vertically from rim flange 12 below blade base portion 16*a* to the apex portion 16*b*. The purpose of such slot is to provide a ventilation opening to permit the escape of moisture and gases from the potato as it is cooked to prevent its explosion. Each slot 28 includes a slot extension 28*a* which extends downwardly from the lower terminus of the slot along the interior of base member 10 to the lower edge of the base member. The slot extension provides a channel for the escape of moisture and gases from a potato which might completely cover slot 28.

The base flange 12 also serves as a stop means to limit a blade's depth of penetration of a potato impaled on it. The stop flange 12 is provided at a level vertically above the lower terminus of slot extensions 28*a* so that the interior of a potato mounted on a blade will always be vented, even at the maximum depth of penetration of the blade into the potato. Although stop flange 12 is shown on the outer or exterior face 19 of the blade, it could be provided instead on the interior face 18.

Another feature of the device, shown best in FIG. 4, is the slight inclination of the blades 16 from the vertical inwardly of the base generally toward the central axis of the base ring. This inclination serves two primary purposes. First, it prevents the base ring from tipping outwardly as a potato is impaled on a blade because of the leverage against tipping that is generated as a potato is pushed downwardly onto the blade. Second, the inclined blades enable nesting of two or more of the devices together in a stack for efficient storage. Such nesting is limited by the rim flange 12, thereby facilitating the ease of separating a device from a nested stack of such devices.

To use the device, a potato 32 is impaled on each blade so that the long axis of the potato extends lengthwise of the blade. Each potato is pushed onto its blade until stopped by flange 12. The device is then lifted by flange 12 and placed in a microwave oven. When the potatoes have been baked, the device is removed from the oven via flange 12. The baked potatoes are lifted off their blades. Having been presplit by the blades, the potatoes are ready for buttering.

From the foregoing description of a preferred embodiment of the invention, a number of obvious modifications will suggest themselves to persons skilled in the art. For example, the blades could assume a number of modified shapes. Instead of being substantially triangular or wedge-shaped as shown, such blades could be in the shape of an arc or a semicircle, for example. Also the base ring need not be a complete annulus or ring as shown. It could be only a portion of an annulus or ring. Furthermore, the base ring need not be circular or a portion of a circle. Instead, it could be triangular or rectangular or of other miscellaneous quadrilateral shapes or portions thereof, so long as the base remains self-supporting. In fact, the base need not be a ring-shaped member at all. It could, for example, be dish-shaped. Similarly, rim flange 12 could be completely eliminated, although it does provide reinforcing strength, limits nesting, and provides a stop for the potatoes. Although the flange stop or other stop means, such as projections on the blade itself, are a convenience and safety feature which ensures adequate venting of the interior of the potatoes while they bake, the device would be operable without them. However more care would be required without them when impaling a potato so as not to completely cover a vent slot. In addition, the vent slots could be channels or depressions in the blades rather than through slots. The slots themselves might be eliminated if other venting means were provided. For example, the shape of the blade itself could provide an inherent venting means.

Obviously the number of blades provided on the base member can be varied depending on the size of the base. However, the number of blades will be limited by the need for providing adequate spacing of potatoes in the microwave oven to ensure that each potato will be cooked to the same extent in the same amount of time in the oven. Overcrowding of potatoes on the device will greatly increase the cooking tme required. For most small household microwave ovens, it is believed that a four-bladed ring would be optimum.

Having illustrated and described the principles of my invention by what is presently a preferred embodiment and having suggested several possible alternative embodiments, it should be apparent to persons skilled in the art that the invention permits of modification in arrangement and detail without departing from such principles. I claim as my invention all such modifications as come within the true spirit and scope of the following claims.

I claim:

1. A baking device especially for baking potatoes in a microwave oven, comprising:

a self-supporting base, an upstanding blade projecting upwardly from said base, said blade having broad opposing surfaces and a thin dimension between said surfaces, said broad surfaces terminating at relatively thin free edges that converge to define a blunt apex of the blade, said blade including a moisture ventilation depression extending continuously in a vertical direction below the level of normal potato penetration in at least one surface of said blade for venting moisture from the potato.

said base and blade being substantially transparent to microwave radiation.

2. A device according to claim 1 including a plurality of said blades spaced apart on said base.

3. A device according to claim 2 wherein said base is a closed ring-like member.

4. A device according to claim 3 wherein said blades are inclined inwardly of said ring-like member.

5. A device according to claim 3 wherein said ring-like member includes a laterally outwardly extending flange portion providing a handle for gripping said frame and a stop for limiting penetration of potatoes on said blades.

6. A device according to claim 2 wherein said base is an annulus.

7. A device according to claim 2 wherein said base comprises a molded plastic ring-like member and said blades are molded integrally with said member and substantially equally spaced apart about said member, each blade including a broad base portion and opposite side edges extending upwardly from said base portion and converging at a rounded apex portion, said edges being sufficiently sharp to readily penetrate a raw potato, said blades being inclined inwardly of said ring-like member, said member including a flange portion extending laterally outwardly thereof.

8. A device according to claim 1 including stop means for limiting the depth of penetration of said blade into a potato.

9. A device according to claim 8 wherein said depression includes a depression portion extending below said stop means.

10. A device according to claim 1 wherein said base defines at least a portion of a ring-like member and said blade is inclined inwardly of said base from the vertical.

11. A device according to claim 1 wherein said blade is generally triangular in shape with the base of the triangle being a greater length than the height of the triangle, and with the apex of the triangle being rounded.

12. A device according to claim 1 wherein said depression includes a slot extending through said blade from a first slot end adjacent a base of said blade to a second slot end adjacent said apex.

13. A baking device especially for baking potatoes in a microwave oven, comprising:

a relatively thin, upright, ring-like self-supporting base, with a laterally outwardly extending flange at the upper end of the base providing a handle, a plurality of upstanding blades spaced apart on said base and extending upwardly from an inner edge of the flange, said blades being inclined toward the center of said base, each blade including opposed broad surfaces merging at thin free edges of sufficient sharpness to penetrate a raw potato, said flange providing a means for limiting penetration of a potato by said blades, each blade terminating at a blunt rounded apex, each base and blades being composed of a microwave transparent material.

14. A device according to claim 13 wherein each blade includes means for ventilating the interior of a potato impaled therein.

15. A device according to claim 14 wherein said means for ventilating includes a ventilation slot extending vertically in at least one surface of said blade and means defining a channel extending downwardly from the lower terminus of said slot in a surface of said base to provide an extension of said slot.

16. A device according to claim 15 wherein said extension extends below said flange.

17. A device according to claim 13 wherein each blade has a thickness dimension which becomes progessively thinner in a direction from a central base portion of the blade toward said thin free edges.

* * * * *